United States Patent [19]

Yoshioka et al.

[11] Patent Number: 4,947,461

[45] Date of Patent: Aug. 7, 1990

[54] MULTI-POSITION ELECTRICAL SWITCH

[75] Inventors: Toshio Yoshioka, Fujieda; Kiyoshi Nakayama, Shizuoka, both of Japan

[73] Assignee: Murakami Kaimeido Co. Ltd., Shizuoka, Japan

[21] Appl. No.: 322,779

[22] Filed: Mar. 3, 1989

[51] Int. Cl.[5] ..... H01H 9/00; H01H 13/70

[52] U.S. Cl. ..... 200/5 R; 200/6 A; 200/513; 200/515; 200/302.1; 200/302.3

[58] Field of Search ..... 200/5 R, 5 A, 6 A, 17 R, 200/18, 302.1–302.3, 512, 513, 515, 306

[56] References Cited

U.S. PATENT DOCUMENTS

| | | | |
|---|---|---|---|
| 4,026,048 | 5/1977 | Hill et al. | 200/6 A |
| 4,611,102 | 9/1986 | Ishida | 200/5 R |
| 4,687,200 | 8/1987 | Shirai | 200/6 A X |
| 4,861,950 | 8/1989 | Yanai et al. | 200/5 R |
| 4,866,221 | 9/1989 | Obermann et al. | 200/5 R |

*Primary Examiner*—J. R. Scott

*Attorney, Agent, or Firm*—Michael J. Striker

[57] ABSTRACT

A multiple electrical switch comprising a casing, a control knob supported on the top edge of the casing for tiltable movement in four directions, a retainer horizontally mounted within the casing and a conversion knob tiltably supported by the retainer and having an upper portion projecting through the central aperture of the control knob. Upper and lower base plates are disposed on respective opposite sides of the retainer, with each of the upper and lower base plates defining a printed circuit board and having a plurality of fixed connecting contacts. The switch further comprise an insulating elastic sheet having a central portion for covering the upper portion of the conversion knob and opposite side peripheral portions for covering respective top surfaces of the upper base plate and each portion including a swell including a movable connecting contact corresponding to a respective one of the plurality of fixed connecting contacts of the upper base plate.

8 Claims, 6 Drawing Sheets

MULTI-POSITION ELECTRICAL SWITCH

BACKGROUND OF THE INVENTION

1. Field of the art

The present invention relates to a multi-position electrical switch to be used for the remote control of rearview mirror of an automotive vehicle. More particularly, the invention relates to a switch which is securely protected from penetration of any moisture or dust thereinto.

2. Description of the prior art

It has known that the most of rearview mirrors of an automotive vehicle are provided at outside thereof and are adjustable from interior thereof. Actuator unit mounted in a mirror body comprises two electrical motors and a driving transmission so as to adjust the reflecting angle of the mirror toward the directions of horizontally rightward or leftward, or vertically upward or downward. Housing of said actuator unit has a supporting member with tilting movable action for mirror elements nearly in its center, and having a pair of slidable pivots with a reasonable distance at a corresponding position to almost the center of said supporting member, thus providing a tilting control of mirror element by means of axial elevation movement of any or both of slidable pivots through driving transmission with driving motors.

In general, a control switch for rearview mirror of automotive vehicle used be so faced sideways against the instrument panel in the interior that very few concerns are taken about moisture or dust penetrating into the control switch operating surface. However, in the recent tendency from the viewpoints of designing purpose or convenience to use, it is mounted facing up sideways against a console box in the interior. In this case, the operating surface will be located close to floor facing upward. Therefore, dust is apt to cover it and spilled liquid like juice can easily enter into the switch as moisture, which results in the accompanying disadvantages such as electrical noise, improper motion or defective contact causing an unexpected operating result beyond the control of a vehicle operator.

SUMMARY OF THE INVENTION

It is therefore an object of this invention to provide a water-resistant switch in which the above mentioned disadvantages are eliminated and penetration of dust is prevented even if the mirror control switch were installed upwardly near the floor of an automobile interior.

In order to achieve the above object, this invention provides a multi-position electrical switch the casing of which is constructed to prevent any dust or moisture from entering by using an insulating sheet having appropriate elasticity and water-resistant property and which is sheathed over the entire top surface of a conversion knob as well as a printed circuit board forming an electrical circuit.

A multi-position electrical switch according to this invention comprises a casing and a control knob supported by top edge of the casing tiltably movable in four direction. A retainer is horizontally mounted within a central portion of the casing. The periphery of the retainer touches the inner walls of the casing. A conversion knob is tiltably retained by the retainer and has its upper half projecting from the center portion of the control knob. An upper base plate is closely disposed on the retainer body. The base plate defines a printed circuit board and has eight (8) fixed connecting contacts. A lower base plate is disposed beneath the retainer defining another printed circuit board and having a plurality of fixed connecting contacts which open or close by turning action of the conversion knob. An insulating rubber sheet sheathes over the entire top surface from the peripheral portion of the upper base plate through the projected upper half of the conversion knob. The insulating sheet forms at its peripheral portion swells in which built-in movable connecting contacts are provided at respective positions corresponding to those of fixed connecting contacts provided on the upper base plate.

According to one feature of the invention, a multi-position electrical switch comprises a square-shaped casing and a control knob supported by top end fringe of the casing tiltably movable in four direction. The control knob has an aperture in the center thereof. A retainer is horizontally mounted within a central portion of the casing. The periphery of the retainer touches the inner walls of the casing. The retainer has supporting plate members on the upper part of the center there a concave portion or recess on the lower part thereof. A conversion knob is retained by the supporting plate members of the retainer tiltably movable rightward or leftward. The conversion knob has an upper half projecting through the aperture of the control knob, and a leg on the lower portion thereof to be extended up to the concave portion or recess of the retainer. A sliding block engages slidably within the portion or recess concave of the retainer and has a cavity on the upper surface thereof to secure the end of the leg of the conversion knob, and a pair of sliding contacts on the lower surface thereof.

According to another feature of the invention, the upper base plate and the lower base plate are electrically connected by lead lines in respective through holes, and the terminals are projected on a lower part of the lower base plate, and the lower part of the casing is covered by a connector cover to protect the terminals. Furthermore, the terminals are connected with the motors for tilt-movable control of a rearview mirror of the automotive vehicle by an electric harness line. According to a further feature of the invention, there is provided a switch wherein the control knob is provided with markings on its upper surface indicating a direction among four reflecting mirror angles to be controlled in upward, downward, rightward or leftward directions whichever, and also has protrusions on the bottom surface thereof for preventing simultaneous press action, eight (8) pushing bars for pressing the swells of the insulating rubber sheet, and corner convexes to be formed at each corner thereof and having a slightly longer length than the pushing bars.

DESCRIPTION OF THE PREFERRED EMBODIMENT

Figure 1:
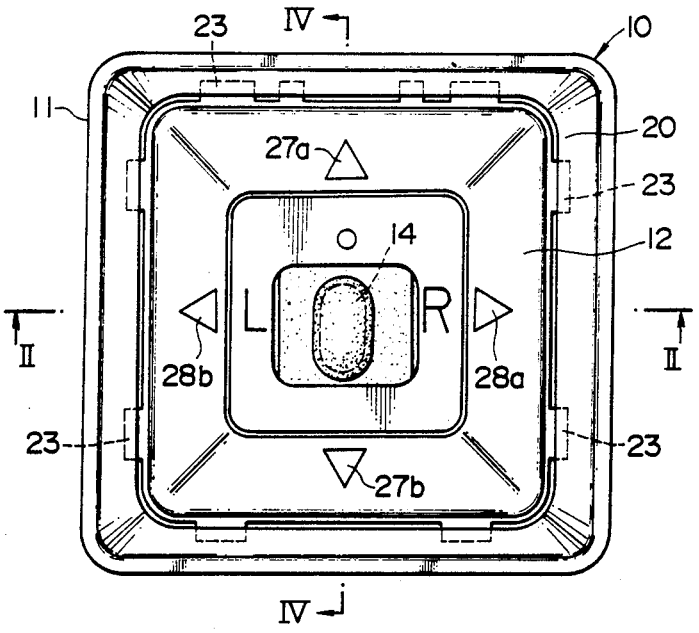
FIG. 1 is a plan view of one embodiment of a multi-position electrical switch according to this invention.

The preferred embodiment of a multi-position electrical switch of the present invention is illustrated generally with reference to FIG. 1 to 4. The switch 10 includes a casing 11 and a control knob 12 mounted by top edge of casing 10 tiltably movable in four directions for adjusting a reflecting angle of a mirror. A retainer 13 is horizontally mounted in the central portion of the casing 10. The periphery of the retainer 13 touches the inner walls of the casing 11. A conversion knob 14 is tiltably retained by the center portion of retainer 13 to move the mirror rightward or leftward whichever to be controlled for setting a desirable reflecting angle. In the casing 11, the retainer 13 is interposed between an upper base plate 15 and a lower base plate 16 having a defined printed circuit board, respectively. The lower portion of the lower base plate 16 is covered by a connector cover 17. An insulating rubber sheet 18 sheathes over the entire top surface of the upper base plate 15 and the conversion knob 14. The insulating rubber sheet 18, as hereinafter described in FIG. 9–10, forms swells 50 wherein built-in individual movable connecting contacts are provided.

As shown in FIG. 1, the casing 11 is square-shaped with its top and base having free ends as seen in the plan view. The casing has a top end fringe 20 on the inside of its upper end, and provides a first slit 21 across one side of a side wall of the casing 11 (see FIGS. 2, 3, and 5), and a second slit 22 across another side of the side wall at a lower position than the first slit 21, as shown in FIG. 3 and 4.

The top end fringe 20 is engaged with projections 23 formed on the outer peripheral end of a side wall of the control knob 12 which is disposed in the casing 11. The top end fringe 20 always keeps the control knob 12 within casing 11 without the control knob having a possibility to slip out from the casing. The top end fringe 20 also acts as a fulcrum on its inside edge to hold the inclined control knob 12 by engaging with the projections 23 at one side when other side of the control knob was depressed and inclined as will be described later (see FIG. 5). A pair of projections 24, 24 are formed partially on an outer periphery of the lower base plate 16, and they are fixedly engaged with the first slit 21 of the casing 11 as shown in FIG. 2; and a pair of projections 25, 25 are formed on outer periphery partially of the upper board of the connector cover 17, and they are fixedly engaged with the second slit 22 as shown in FIG. 3 and 4.

Figure 7:
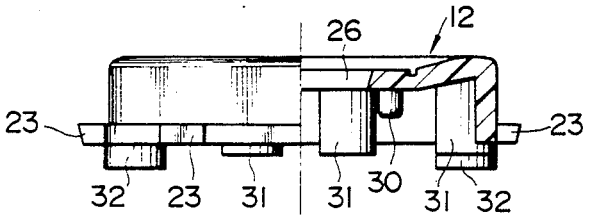
FIG. 7 is enlarged view of a portion of the cross-section taking along the line VII—VII in FIG. 6.
Figure 8:
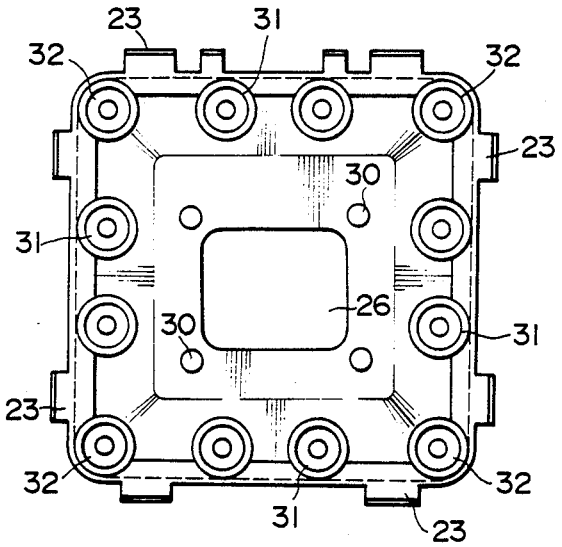
FIG. 8 is a back view of a control knob shown in FIG. 6.

An aperture 26 is provided in the center of the upper surface of the control knob 12. An upper half of the conversion knob 14 covered by the center portion of insulating rubber sheet 18 passes through aperture 26. The control knob 12 is also provided with markings *27a*, *27b*, *28a*, *28b* on its upper surface so as to provide an indication for control of either the mirror itself or each direction of a mirror reflecting angle by tilting action. The markings R and L are for mirror conversion between right or left. They are located closely to the aperture 26. Markings for four direction control are located at corresponding four sides of the square further away from the aperture than R and L but near a center of a respective side. In conformity with one of the markings of *27a*, *27b*, *28a*, and *28b*, when one of the four sides of the control knob 12 is pushed in on top, the swells 50 of the insulating rubber sheet 18 are collapsed and depressed by positioned pushing bars 31, 31, and the movable connecting contacts 51, 51 come down and close some of the fixed connecting contacts on the upper base plate 15. For this reason, various types of bars 31 and 32 are provided on the bottom surface of the control knob 12. Protrusions 30 are formed adjacent to each of four corners of the aperture 26 for preventing simultaneous press action. The pushing bars 31 are formed converging to each side wall of the control knob of 2 bars as 8 in total, and the corner bars 32 are formed at each corner of the control knob body slightly extending further downward than the bars 31 to prevent needless inclination, as illustrated in FIG. 7 and 8. If the control knob 12 was eventually pressed to a predetermined depth without being inclined, the protrusions 30 prevent any further movement as they reach the shoulder portions 36 of the retainer 13, and thus all of the movable connecting contacts 51 stop at positions located from the fixed connecting contacts of the upper base plate 15. Simultaneously, when the protrusions 30 reach the shoulder portions 36, the protrusions 30 bounce off due to elasticity reaction to absorb the external force caused by the insulating rubber sheet 18 sheathed over the retainer 13. Thus, there is no way for the control knob 12 to go down.

Figure 2:
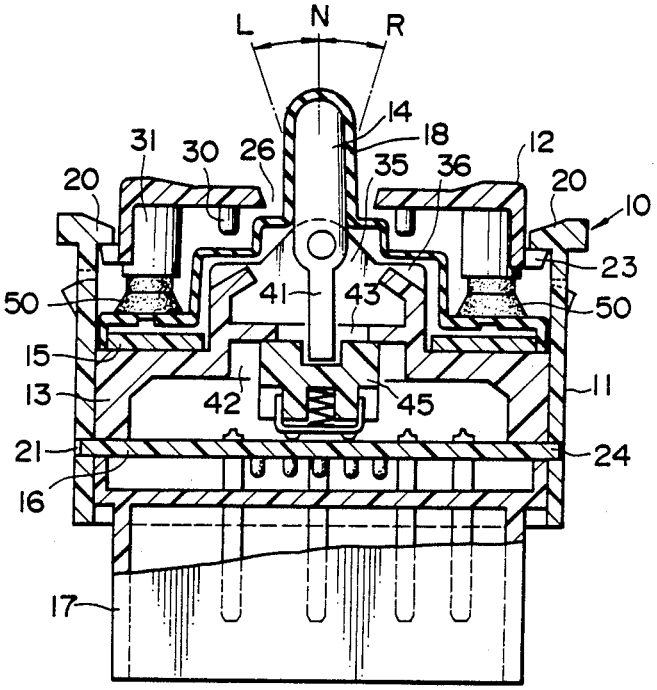
FIG. 2 is a sectional view taken along the line II—II in FIG. 1.
Figure 3:
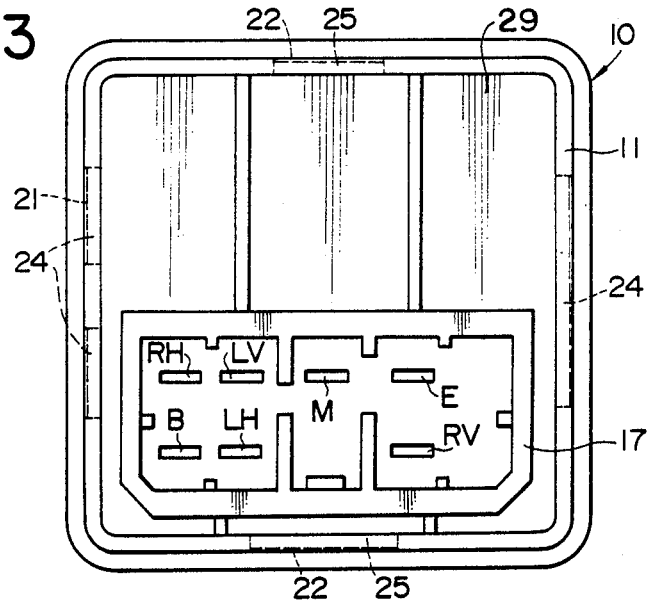
FIG. 3 is a back view of the switch shown in FIG. 1.
Figure 4:
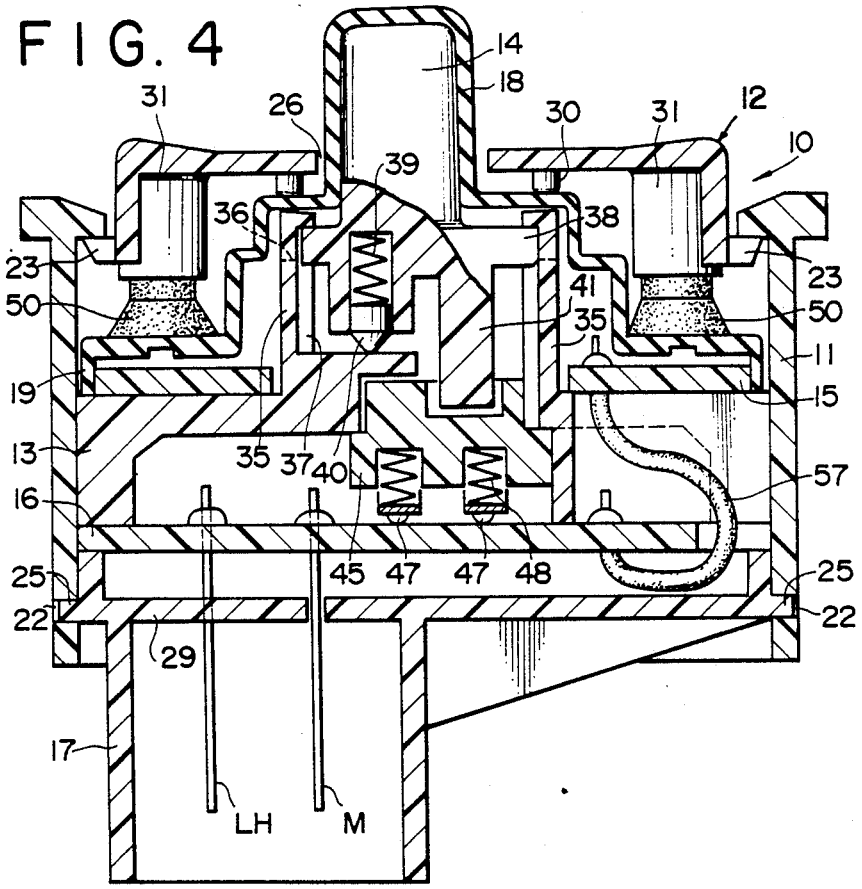
FIG. 4 is an enlarged sectional view taken along the line IV—IV in FIG. 1.

As shown in FIGS. 2 and 4, a pair of supporting plate members 35 extend up at a proper distance from each other in the central portion of the retainer 13. Grooves 37 provided face to face on inside walls of the plate members 35 engage with axial portions 38 of the conversion knob 14. A pin 40 projecting on the lower part of the conversion knob 14 is biased by a spring 39, and a leg 41 extends downward adjacent to the pin 40. A recess 42 is reamed in the center portion of the lower part of the retainer 13 wherein the sliding block 45 is engaged, and a cavity 46 is provided on the upper surface of the sliding block 45 to secure the end of the leg 41. A pair of sliding contacts 47 in the lower surface of the block 45 are biased by spring 48. The contacts 47 are slidable on the fixed connecting contacts of the lower base plate 16.

Figure 9:
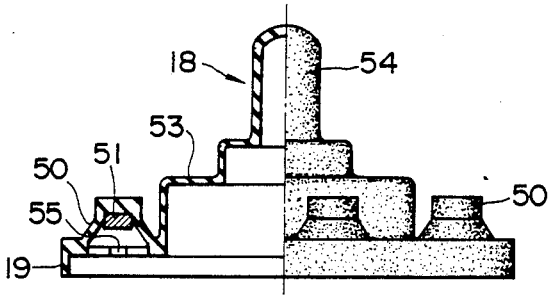
FIG. 9 is an enlarged sectional view showing an insulating rubber sheet.
Figure 10:
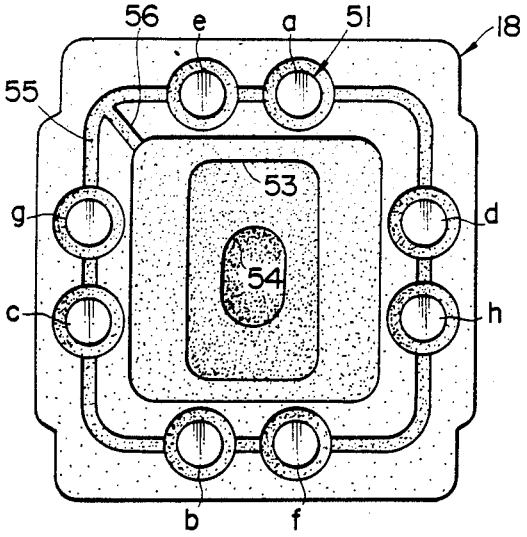
FIG. 10 is a back view showing the insulating rubber sheet.

As shown in FIG. 9 and 10, the insulating rubber sheet 18 has eight swells 50 on its peripheral portion, and inside of the swells, there are provided movable connecting contacts 51 to contact from time to time the fixed connecting contacts of the upper base plate 15. The eight swells 50 have a shape of a truncated cone due to the elasticity of the rubber. The swells are disposed under the control knob 12 and keep the knob floating upward because of their flexibility. In the central portion of the rubber sheet 18, a projecting square step 53 is formed. The step 53 overlies the supporting plate members 35 of the retainer 13, and a hollow hump 54 projects upward in the center of the protruded step 53. The upper half of the conversion knob 14 is sheathed completely by the rubber sheet 18.

Figure 11:
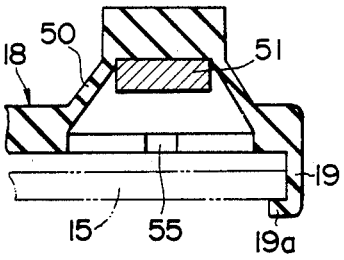
FIG. 11 is a partially enlarged sectional view of an insulating rubber sheet showing another modified embodiment according to this invention.

Further, the peripheral side end of the insulating rubber sheet 18 forms a skirt portion 19 to cover the side end of the upper base plate 15. It can be understood that to make a complete protection of the side end of the base plate 15, as illustrated in FIG. 11, lip 19*a* may be further extended from the skirt portion 19 to be bent at a right angle in a manner to lap the entire part of such side end of the plate 15 sufficiently. In a rear surface of the rubber plate 18, recesses 55 are formed for linking all swells 50. The recesses 55 communicate with air vents 56 extending to the protruded step 53 as a part of extention toward the center. Since the insulating rubber sheet 18 is disposed inside the casing 11 by sheathing over the peripheral portion of the upper base plate 15 including the fixed connecting contacts as well as the upper half of the conversion knob 14, any dust or moisture can be completely prevented from entering from the space between the conversion knob 14 and casing 11 inside the switch. It is apparent that a precise connecting contact is provided all the time without causing any defective contact connection or wrong reaction afterward.

As shown in FIG. 4, the upper base plate 15 and the lower base plate 16 are connected by the lead lines 57. The terminals are projected on the lower part of the lower base plate 16, and the lower part of the casing 11 is covered by a connector cover 17 to protect the terminals. The terminals contain respective connector ends B, E, RH, LH, M, RV, and LV, which are available for power source, ground, inclination of horizontal directions, motor control, inclination of vertical direction as shown in FIG. 3.

Figure 12:
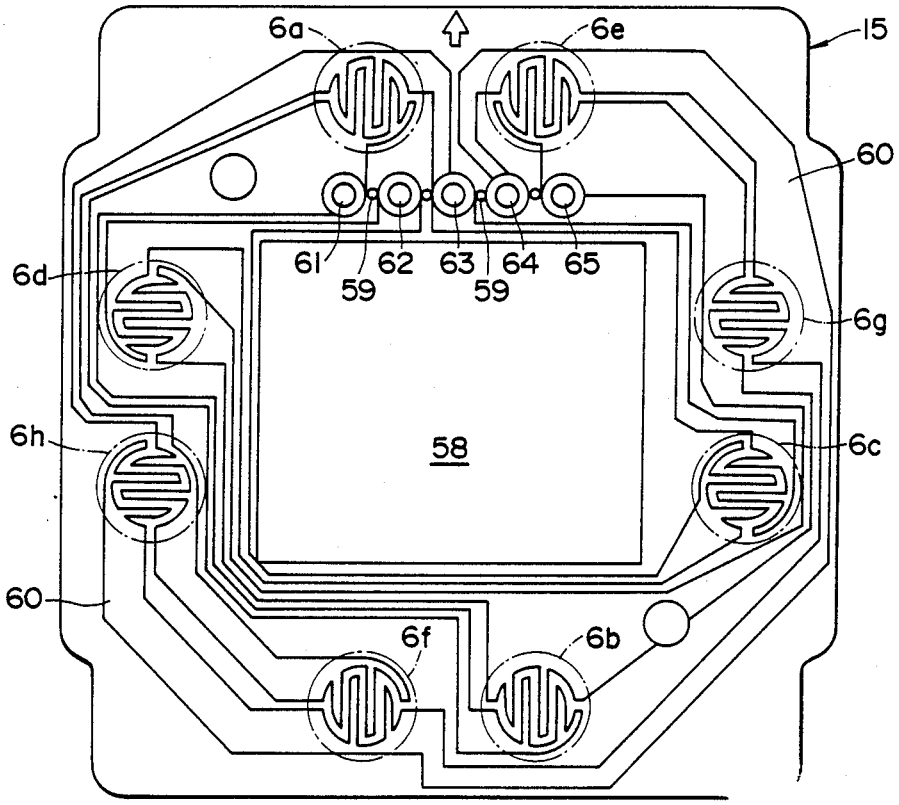
FIG. 12 shows an enlarged plan view of an upper base plate.
Figure 13:
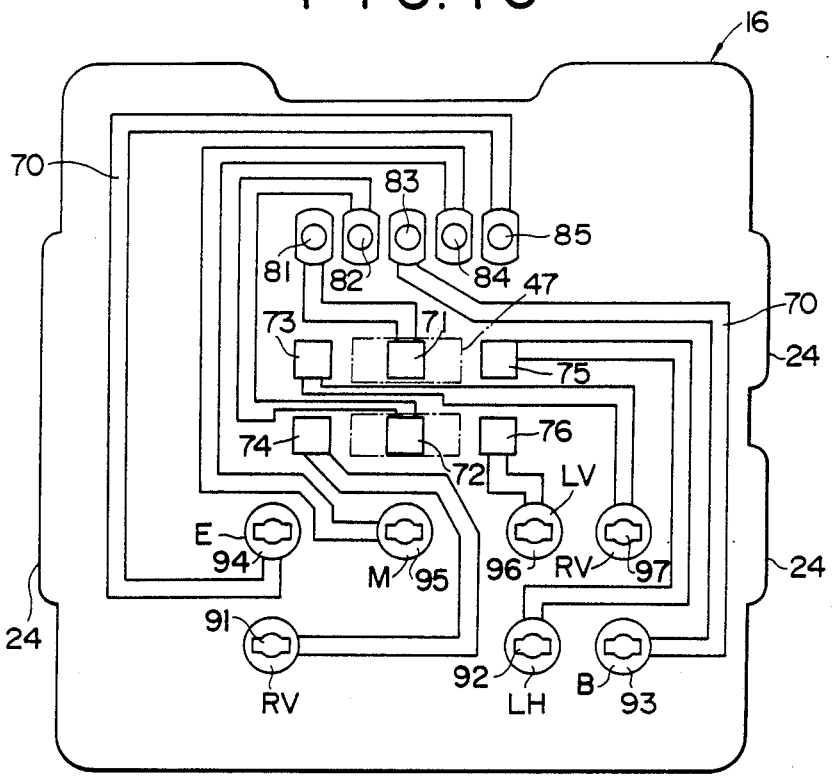
FIG. 13 shows an enlarged plan view of a lower base plate.

The upper base plate 15 and lower base plate 16 have printed circuit boards on a side thereof with each board having a predetermined printed pattern interconnected as shown in FIG. 12, a plane view of the upper base plate 15, and in FIG. 13, a plane view of the lower base plate 16.

The upper base plate 15 comprises a square opening 58 in its center for insertion of the conversion knob 14, eight pair of the fixed connecting contacts 6*a*, 6*b* . . . 6*h* which are formed by the printed pattern 60 of their circumference, five through-holes 61–65 lined crosswise close to the contacts of 6*a* and 6*e* to solder lines 57. air vent orifices 59 are located between the through-holes.

The lower base plate 16 comprises a printed pattern 70 formed on the surface, six pair of fixed connecting contacts 71–76 at the positions corresponding to those of the sliding contacts 47, 47, five through-holes 81–85 for communication of lead lines, and seven through-holes 91–97 for connecting terminals. Among the fixed connecting contacts, central upper and lower contacts 71 and 72 are common contacts, their left side contacts 73 and 74 are respectively connected to terminals of RH and RV for a right side mirror reflecting angle control for a horizontal direction and for a vertical direction, and their right side contacts 75 and 76 are respectively connected to terminals of LH and LV for a left side mirror reflecting angle control for the horizontal direction and for the vertical direction. The position of the sliding contacts 47 of the sliding block 45 as indicated by dotted line in FIG. 13, defines now the sliding block 45 in a neutral position. When the block 45 is shifted leftward from the neutral position by the conversion knob 14 inclined rightward, it defines selection of the right side mirror control, on the other hand, when the block 45 is shifted rightward by the knob 14 inclined leftward, it defines selection of the left side mirror control.

Figure 14:
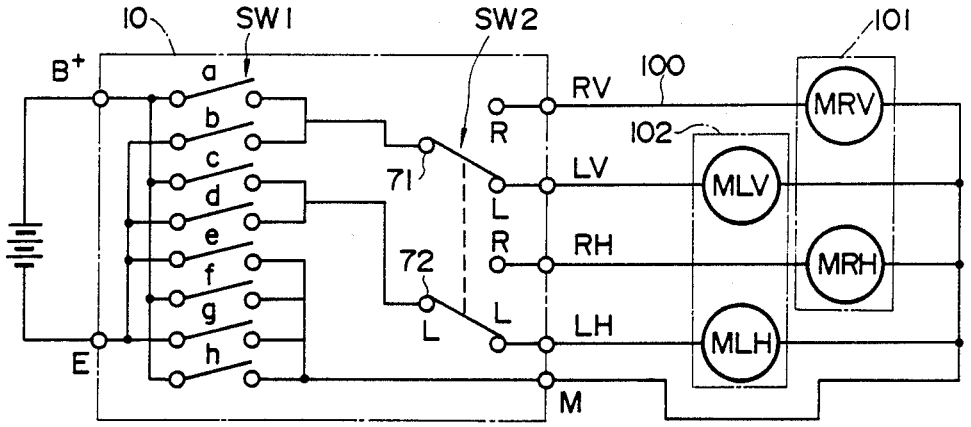
FIG. 14 is an electrical circuit diagram for the switch according to this invention showing a preferred embodiment to be applicable for an outside rearview mirror of an automotive vehicle.

FIG. 14 shows a door mirror control circuit utilizing the above mentioned control switch. The right side door mirror 101 installed outside of an automobile have, built-in motors for vertical and horizontal angle control designated as MRV and MRH, also the left side mirror have built-in similar designated as MLV and MLH. The switch SW1 for polarity conversion of the above each left side and right side motors has movable connecting contacts a, b, c, . . . h (these are collectively designated by numeral 51 in FIG. 10) disposed in individual swells 50, and the fixed connecting contacts of base plate 15. Further, the sliding contacts 71–76 for mirror conversion of left side or right form the switch SW2. The terminals RV, LV, RH, LH and M are respectively connected to each motor of left side or right side door mirror 101, 102 noting the designated mirror motors in FIG. 14.

Figure 5:
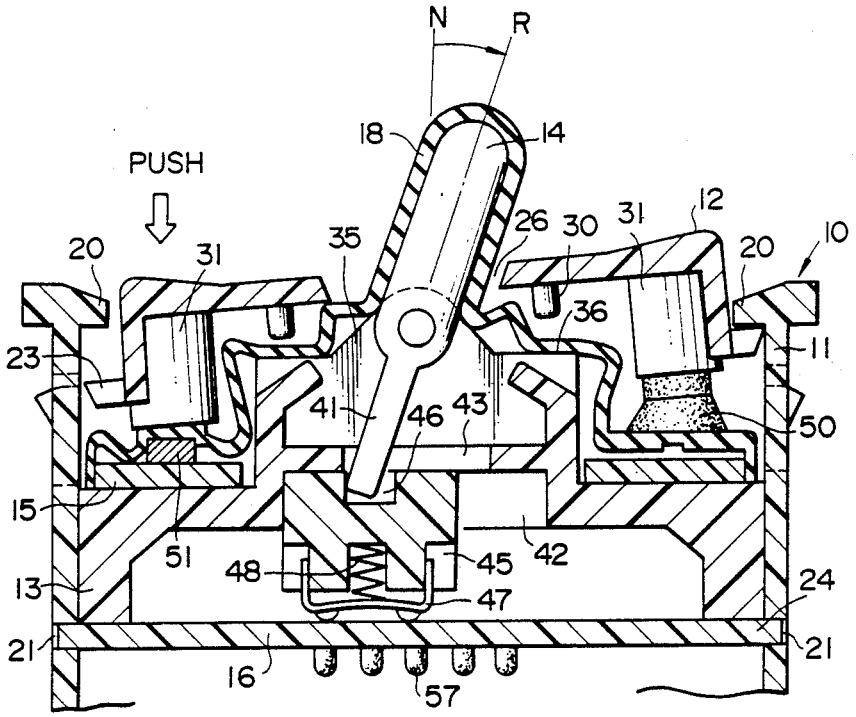
FIG. 5 is an enlarged sectional view showing an operated position of switch according to this invention.
Figure 6:
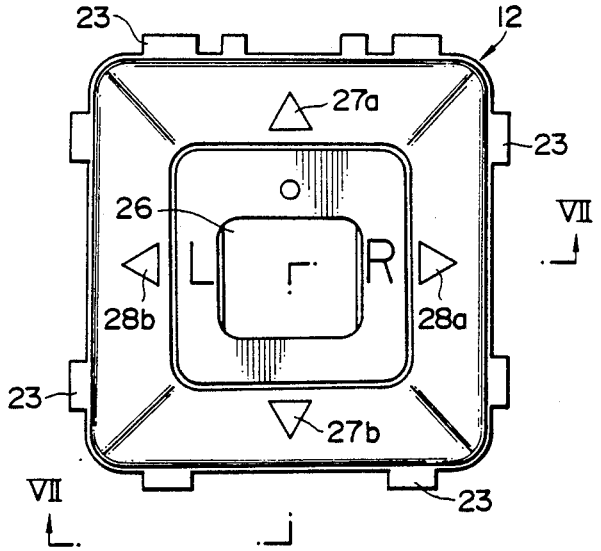
FIG. 6 is a plan view of a control knob.

The operation of the switch is now discussed. First all, the conversion knob 14 is to be turned from the neutral position to the left or right position, whichever, depending on the adjusted. For example, when the conversion knob expectation as to which side the door mirror should be adjusted. For example, when the conversion knob 14 is inclined to right, the legs 41 of the knob swing around a center of axial portions 38, which makes the sliding block 45 shift to the left side of FIG. 2. As a result of this shifting, the fixed connecting contacts 73, 74 are closed, and the right side mirror control is selected. Then, as shown in FIGS. 1 and 5, when the portion of the marking 28*b* of the control knob 12 is the pushing bars 31 move downward causing the swells 50 to collapse, whereby the fixed connecting contacts 6*d*, 6*h* are closed by their movable connecting contacts g, c As a result, the motor of the right side mirror MRH is actuated. It is quite obvious that the motor is running while the control knob 12 pushed in. However, when pressure is released, the swells 50 return to their original shape due to the recess 55, and the air vent 56 permits entry of air into the elastic swells 50 via recess 55 which interconnects the swells. The knob 12 also bounces off because of elasticity of the swells, whereby the connection contacts are released. Consequently, the motor stops, and any angle of mirror control is again possible. Likewise, if one of the markings among 27*a*, 27*a*, or 28*a* is pushed in, a corresponding direction of a mirror angle can be controlled. As to the knob depression improper pressing, namely, needless inclination is evaded because of the corner bars 32. Also another prevention was observed when the entire knob was depressed. The protrusions 30 for blocking suspend any further movement of the knob as they reach the shoulder portion 36 of the supporting members 35 of the retainer 13, being separated from the shoulder portions 36 by the rubber sheet 18. Thus, all of the connecting contacts 6*a*, 6*b*, . . . 6*h* are in an open condition.

According to the invention, described above, the drawbacks of this type of switch, such as penetration of dust or moisture through the spaced gap between the switch casing and the control knob, can be eliminated.

In particular, even if this type of switch were installed upsidedown on the console box portion in the vehicle interior, moreover, even if controlling surfaces were exposed to some liquid, neither water nor moisture penetrates into a core portion of the printed circuit or connecting contact portion of the switch. Also, any defective connection of contacts or wrong connection is prevented.

While the invention is partially shown and described with reference to a preferred embodiment thereof, it will be understood by those skilled in the art that various changes and details may be made therein without departing from the spirit and scope of the invention as defined in the claims.

We claim:

1. A multi-position electrical switch comprising:

a casing having a top edge and an inner wall;

a control knob supported on said top edge of said casing for tiltable movement in four directions and having a central aperture;

a retainer horizontally mounted within said casing and having peripheral surfaces engaging said inner wall of said casing;

a conversion knob tiltably supported by said retainer and having an upper portion projecting through said central aperture of said control knob;

upper and lower base plates disposed on respective opposite sides of said retainer, each of said upper and lower base plates defining a printed circuit board and having a plurality of fixed connecting contacts; and an insulating elastic sheet having a central portion for covering said upper portion of said conversion knob and opposite side peripheral portions for covering respective top surfaces of the upper base plate, and each peripheral portion including at least one swell, each swell comprising a movable connecting contact corresponding to a respective one of said plurality of fixed connecting contacts of the upper base plate.

2. A multi-position electrical switch as set forth in claim 1, wherein the lower base plate includes downward projecting terminals, said switch further comprising lead means for electrically connecting said upper and lower base plates; and a connector cover for covering a lower part of said casing for protecting said downwardly projecting terminals.

3. A multi-position electrical switch as set forth in claim 1, wherein said control knob has top and bottom surfaces, said switch further comprising a plurality of markings on said top surface of said control knob indicating upward, downward, leftward and righward directions of movement of said upper portion of said conversion knob; a plurality of protrusions extending from said bottom surface of said control knob; a plurality of pushing bars located on said control knob for depressing said swells; and a plurality of corner bars at each corner of said control knob and having a length that exceeds a length of said pushing bars.

4. A multi-position electrical switch as set forth in claim 1, wherein said central portion comprises a hollow hump for covering said upper portion of said conversion knob, said insulating elastic sheet including a skirt portion extending from end portions of said peripheral portions thereof for covering side end surfaces of the upper base plate, and recess means for communicating said swells with atmosphere.

5. A multi-position electrical switch as set forth in claim 4, wherein said insulating elastic sheet has a short lip extending at a right angle from a lower end of said skirt portion.

6. A multi-position electrical switch as set forth in claim 1, wherein said insulating elastic sheet is formed of a rubber material.

7. A multi-position electrical switch as set forth in claim 1, wherein said casing has a square shape, said retainer has a central portion having top and bottom surfaces, supporting plate members extending from the top surface of said central portion, and a recess formed in the bottom surface of said central portion, said conversion knob has a leg extending into said recess in the bottom surface of said central portion of said retainer, and said switch further comprises a sliding block slidable in said recess in the bottom surface of said central portion of said retainer and having upper and lower surfaces, a cavity formed in the upper surface for receiving said leg of said conversion knob, and sliding contacts located on the lower surface.

8. A multi-position electrical switch as set forth in claim 7, wherein the upper base plate has a square opening through which said supporting plate members of said retainer extend.

* * * * *